United States Patent [19]

Hara et al.

[11] Patent Number: 4,708,101

[45] Date of Patent: Nov. 24, 1987

[54] DRIVING APPARATUS FOR INTAKE AND EXHAUST VALVES OF INTERNAL COMBUSTION ENGINE

[75] Inventors: Seinosuke Hara, Yokosuka; Hiromichi Ofuji, Yokohama; Kazuyuki Miisyo, Yokohama; Yasuo Matsumoto, Yokohama; Manabu Kato, Tokyo, all of Japan

[73] Assignee: Nissan Motor Co., Ltd., Yokohama, Japan

[21] Appl. No.: 810,176

[22] Filed: Dec. 18, 1985

[30] Foreign Application Priority Data

Dec. 20, 1984 [JP] Japan ..... 59-269429
Apr. 19, 1985 [JP] Japan ..... 60-85086

[51] Int. Cl.[4] ..... F01L 1/34; F01L 1/10; F01L 1/18

[52] U.S. Cl. ..... 123/90.16; 123/90.17; 123/90.18

[58] Field of Search ..... 123/90.15, 90.16, 90.17, 123/90.18

[56] References Cited

U.S. PATENT DOCUMENTS

| | | | |
|---|---|---|---|
| 1,957,181 | 5/1934 | Mitchel | 123/90.15 |
| 3,401,572 | 9/1968 | Bailey | 123/90.15 |
| 3,413,965 | 12/1968 | Gavasso | 123/90.16 |
| 3,827,413 | 8/1974 | Meacham | 123/90.15 |
| 4,421,074 | 12/1983 | Garcea et al. | 123/90.15 |
| 4,481,912 | 11/1984 | Stwiorok et al. | 123/90.15 |
| 4,503,818 | 3/1985 | Hara et al. | 123/90.16 |
| 4,526,142 | 7/1985 | Hara et al. | 123/96.16 |
| 4,539,951 | 9/1985 | Hara et al. | 123/90.17 |
| 4,567,861 | 2/1986 | Hara et al. | 123/96.16 |
| 4,601,266 | 7/1986 | Oldfield et al. | 123/90.15 |

FOREIGN PATENT DOCUMENTS

| | | | |
|---|---|---|---|
| 50-76428 | 11/1973 | Japan . | |
| 146213 | 11/1980 | Japan | 123/90.16 |
| 44715 | 3/1982 | Japan | 123/90.15 |
| 57-188717 | 11/1982 | Japan . | |
| 103908 | 6/1984 | Japan | 123/90.15 |
| 119008 | 7/1984 | Japan | 123/90.16 |

*Primary Examiner*—Ira S. Lazarus
*Attorney, Agent, or Firm*—Schwartz, Jeffery, Schwaab, Mack, Blumenthal & Evans

[57] ABSTRACT

There is provided an apparatus for driving intake and exhaust valves (12) of an internal combustion engine. The apparatus comprises a valve lift controlling means (16) connected to the valves to control the lift of the valves in response to the engine operating conditions, valve driving cams (13) fixed on a cam shaft (14) and being in contact with the valve lift controlling means (16), and a phase controlling means (23) arranged on the cam shaft (14) to control the relative rotational phase of the valve driving cams, i.e., the open and close timing of the valves (12) in response to the engine operating conditions.

17 Claims, 31 Drawing Figures

DRIVING APPARATUS FOR INTAKE AND EXHAUST VALVES OF INTERNAL COMBUSTION ENGINE

BACKGROUND OF THE INVENTION

1. Field of the Invention

The present invention relates to a driving apparatus for intake and exhaust valves of an internal combustion engine of, for instance, a vehicle, and particularly to a driving apparatus which can control variably the rotational phase and the lift of valve of the engine according to the engine operating conditions.

2. Description of the Prior Art

An example of the apparatus which controls the open and close timing and the lift of the intake and exhaust valve is disclosed in U.S. Pat. No. 3,413,965. The apparatus includes an rocker arm, one end of which contacts a valve driving cam and the other end being coupled with the stem end of an intake or exhaust valve so that the rocker arm may be freely pivotal around the point of coupling. The back surface which is curved of the rocker arm contacts a lever. According to the rotational movement of the valve driving cam, the rocker arm provides rocking motion with the point of contact between the rocker arm and the lever as a fulcrum to drive the valve. Cne end of the lever is pivotally supported by an engine body, and the pivotal movement (slant) of the lever is controlled by a valve lift controlling cam which is arranged to contact the other end of the lever. The valve lift controlling cam is turned by means of a hydraulic actuator, etc., according to engine operating conditions so that the lift characteristic of valve may variably controlled.

In the above prior art example, if the valve open timing is delayed in the slow-speed and small-load operating conditions in comparison with the high-speed and large-load conditions of the engine, the valve close timing will simultaneously be advanced. As a result, the closure timing of intake valve comes close to the bottom dead center in an intake stroke, if the valve open timing is delayed in the slow-speed and small-load operating conditions to reduce the overlap between the intake and exhaust valves, reduce the residual gas in the combustion chamber and improve the combustion conditions. Thus, the pumping loss may not be decreased, and the thermal efficiency may not be improved.

Another example of the valve driving apparatus which controls the rotational phase of a valve driving cam is disclosed in Japanese Patent Application Publication No. 50-76428. The apparatus includes a plurality of weights arranged on a cam gear which is fixed to a cam shaft to rotate a cam for driving a valve. The weights are pivotally fixed on the cam gear and moved due to the centrifugal force applied on the weights, if the cam gear is rotated. The pivotal movement of the weights changes the rotational phase of the cam.

In the above prior art example, the valve open and close timing is advanced or delayed in response to engine speed under the constant lift of valve. As a result, if the intake valve close timing is advanced in the slow-speed operating state of engine to bring the timing close to the bottom dead center to improve the changing efficiency, the intake valve open timing comes close to the top dead center so that the counter flow of exhaust gas may be increased during the overlap period of the intake and exhaust valves. Thus, the charging efficiency will not be improved. In the slow-speed operating state, the combustion conditions will be deteriorated due to the counter flow of exhaust gas so that the stable low-speed operability will not be secured.

SUMMARY OF THE INVENTION

An object of the present invention is to provide an improved apparatus for driving intake and exhaust valves of an internal combustion engine, capable of controlling variably the open and close timing of the intake and exhaust valves as well as controlling the lift of the intake and exhaust valves according to the engine operating conditions to optimize the operation of valves.

In order to accomplish the object and advantages, the present invention provides an apparatus for driving intake and exhaust valves of an internal combustion engine, comprising a valve lift controlling means connected to the valves to control the open and close timing and the lift of the valves in response to the engine operating conditons, valve driving cams fixed on a cam shaft and being in contact with the valve lift controlling means, and a phase controlling means arranged on the cam shaft to control the relative rotational phase of the valve driving cams in response to the engine operating conditons.

BRIEF DESCRIPTION OF THE DRAWINGS

The present invention will be described with reference to accompanying drawings in which.

DETAILED DESCRIPTION OF THE EMBODIMENT

Figure 1:
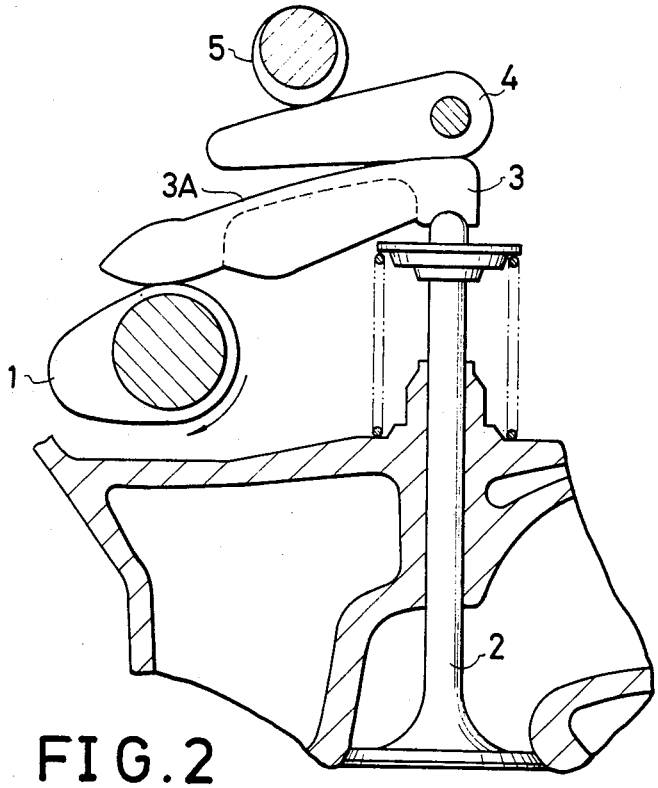
FIG. 1 PRIOR ART
FIG. 1 is a vertical cross sectional view showing a valve lift controlling unit according to a prior art.
Figure 2:
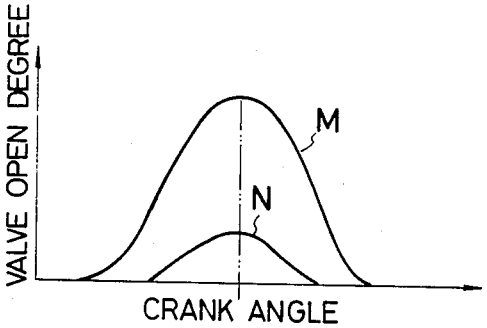
FIG. 2 PRIOR ART
FIG. 2 is a diagram showing the valve lift characteristic of the unit shown in FIG. 1.
Figure 3:
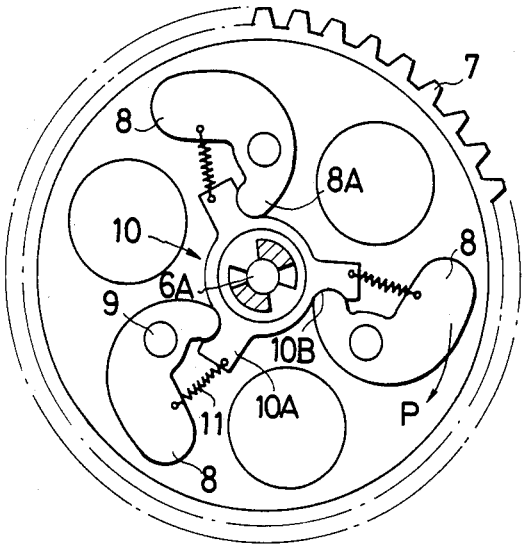
FIG. 3 PRIOR ART
FIG. 3 is a front view showing the main parts of a valve driving apparatus according to a prior art.
Figure 4:
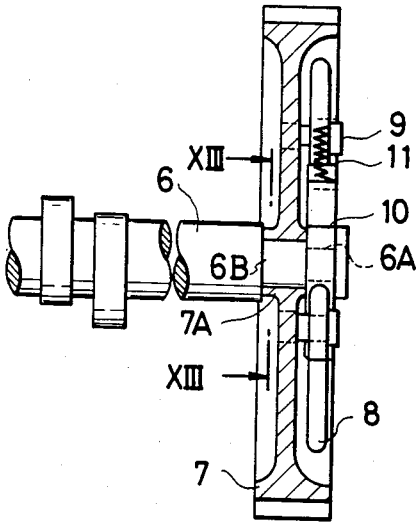
FIG. 4 PRIOR ART
FIG. 4 is a cross sectional view of the apparatus shown in FIG. 3.

To facilitate the understanding of the present invention, a brief reference will be made to a prior art. FIGS. 1 and 2 show an apparatus disclosed in U.S. Pat. No. 3,413,965 in which the lift characteristics (open and close timing, and lifting amount) of an intake and exhaust valve are variably controlled to optimize always the valve overlap and incoming charge efficiency.

In the figures, one end of an rocker arm 3 contacts a valve driving cam 1, and another end thereof coupling with the stem end of an intake and exhaust valve 2 so that the rocker arm 3 may be supported in a freely pivotable manner. The back surface 3A of the rocker arm 3 is curved. The back surface 3A contacts the lever 4 to provide rocking motion for the both ends of the rocker arm 3 with the lever 4 as a fulcrum so that the lift of the cam 1 is transmitted to the intake and exhaust valve 2. One end of the lever 4 is pivotally supported by an engine body to provide free rocking motion. The rocking position (slant) of the lever 4 is controlled with a lift controlling cam 5, which contacts the other end of the lever 4. The control is made by rotating the lift controlling cam 5 to a proper phase acording to the engine operating condition by means of a hudraulic actuator, etc. As a result, the position of fulcrum which is a contacting point between the back surface 3A of the rocker arm 3 and the lever 4 is varied to control variably the lift characteristic of the intake and exhaust valve 2.

If the amount of push of the lever 4 caused by the lift controlling cam 5 is large, the free end of the lever 4 will locate closely to the rocker arm 3 in a base circle state. Accordingly, the valve open timing of the intake and exhaust valve 2 is advanced and the lift is increased as indicated by the curve M shown in FIG. 2. If the amount of push due to the lift controlling cam 5 is small, the free end of the lever 4 is located far from the rocker arm 3 even in the base circle state of the cam 1. As a result, the valve open timing of the intake and exhaust valve 2 is delayed and the lift is decreased as indicated by the curve N shown in FIG. 2.

Figure 5:
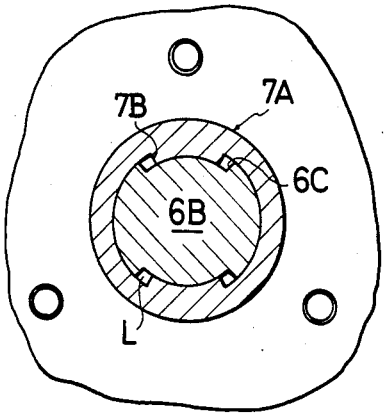
FIG. 5 PRIOR ART
FIG. 5 is a view taken along the line XIII—XIII shown in FIG. 4.
Figure 6:
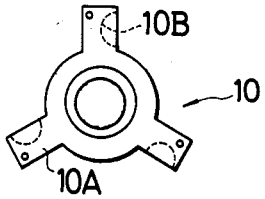
FIG. 6 PRIOR ART
FIG. 6 is a view showing the boss of the apparatus shown in FIG. 3.
Figure 7:
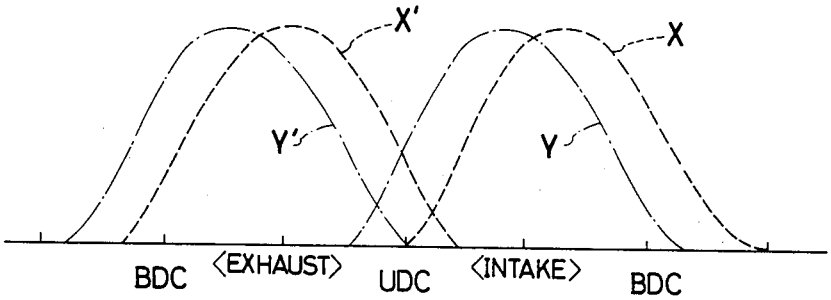
FIG. 7 PRIOR ART
FIG. 7 is a diagram showing the valve lifting characteristics.

The other prior art example is generally disclosed in Japanese Patent Application Publication No. 50-76428 and is shown in FIGS. 3 to 7. In the figures, the numeral 6 represents a cam shaft, 7 a cam gear, and 8 weights. When an engine is rotated with specified speed, each weight 8 rotates around the axis of a boss 7A of the cam gear 7 together with the cam gear 7 through a stud 9 supporting each weight 8. At this moment, each weight 8 rotates around the axis of the stud 9 in an arrow P direction due to the centrifugal force. An inner end 8A of the weight 8 presses in a direction opposite to the arrow P a recess 10B of an arm 10A of a boss 10 (FIG. 6) screwed to a spline shaft 6A of the cam shaft 6. The moment generated around the stud 9 due to said pressing force and the pulling force of a spring 11 is equal to the moment around the stud 9 generated by the centrifugal force acting upon each weight 8. The moment around the axial center of the cam shaft 6 caused by pushing force given to the recess 10B is equal to the torque of the cam shaft 6 to open and close the valve. Therefore, an angular phase is maintained between the engaging portion 6B of the cam shaft 6 and the boss portion 7A of the cam gear 7. Namely, a gap L between the groove 6C of the engaging portion 6B and the stopper 7B of the boss portion 7A is maintained at a specific value which is determined by the revolving speed of the engine (FIG. 5).

If the revolving speed of the engine is incresed above a predetermined value, the weights 8 receive great centrifugal force to press harder the recesses 10A with the inner end portions 8A and rotate the boss 10. Accoridngly, a new relative angular displacement is caused between the cam shaft 6 and the cam gear 7 to delay the open and close timing of the intake and exhaust valve with the lift being constant (curves X and X' shown in FIG. 7). If the revolving speed of the engine is decreased below the predetermined value, the open and close timing of the intake and exhaust valve is advanced (curves Y and Y' shown in FIG. 7).

Figure 8A:
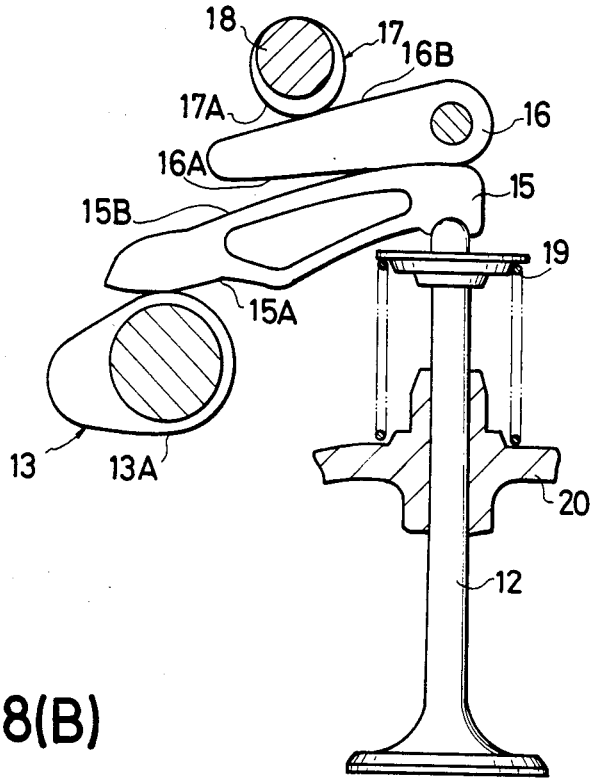
FIG. 8(A) is a vertical cross sectional view showing an embodiment of a valve lift controlling apparatus according to the present invention.
Figure 8B:
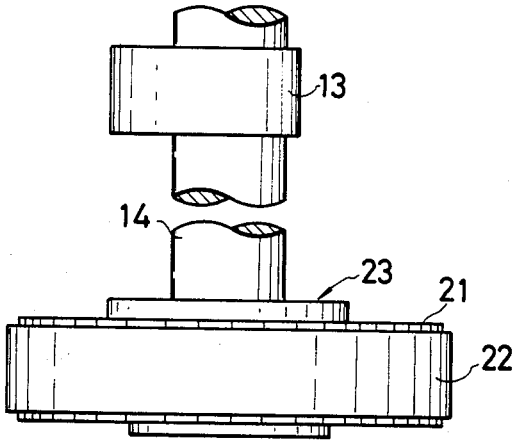
FIG. 8(B) is a plan view of the apparatus shown in Fig. 8(A)

The details of the present invention are now described with reference to accompanying drawings. FIGS. 8(A) to 13 are views showing an embodiment according to the present invention. In FIG. 8(A), the numeral 12 represents an intake valve (or an exhaust valve), and 13 an intake valve driving cam having a specified cam surface 13A. The cam 13 is fixed to a cam shaft 14. A rocker arm 15 has a lower surface 15A, one end of which contacts the driving cam 13, and the other end engages with the stem end of the intake valve 12. A back surface 15B of the rocker arm 15 has at the upper portion a concave portion with a predetermined curvature. A lever 16 has a flat lower surface 16A which contacts the back surface 15B of the rocker arm 15, said contacting point becoming a fulcrum. A flat upper surface 16B of the lever 16 engages with a lift control cam 17. The lift control cam 17 has a specified cam surface 17A which is controlled to rotate according to the engine operating conditions by an actuator, which will be described later, through a cam control shaft 18. The numerals 19 and 20 represent a valve spring and a cylinder head respectively. As shown in FIG. 8(B), one end of the cam shaft 14 is connected to a timing pully 21 which is connected to an engine crank shaft (not shown) through a toothed timing belt 22. At the connecting portion (fixing portion) of the timing pulley 21 and the cam shaft 14, there is assembled a phase control unit (phase control means) 23 for controlling the phase of rotation of the driving cam 13.

The phase control unit 23 will be described with reference to FIGS. 9 and 10.

The phase control unit 23 comprises an annular piston 25 which slides freely to reciprocate in an annular cylinder 21*a* formed in the timing pulley 21 to define a hydraulic chamber 24 in the cylinder 21A, a slider 27 which abuts against the piston 25 and slides along the cam shaft 14 operated by the reciprocating movement of the piston 25 against the action of a coil spring 26, and a stopper member 28 which regulates the movement of the slider 27 through the coil spring 26. As shown in FIG. 10, the slider 27 is provided with a spiral female spline 27A formed on the inner surface of the hollow portion of the slider 27. One end of the slider 27 is provided with a flange portion 27B which abuts against the piston 25, the other end of the slider 27 being provided with a projection 27C which is supported in a groove 21B in a freely slidable manner. The groove 21B is formed on the inner wall of the cylinder 21A. As shown in FIG. 10, one end of the cam shaft 14 is provided with a spiral male spline 14A which engages with the spline 27A of the slider 27.

Figure 9:
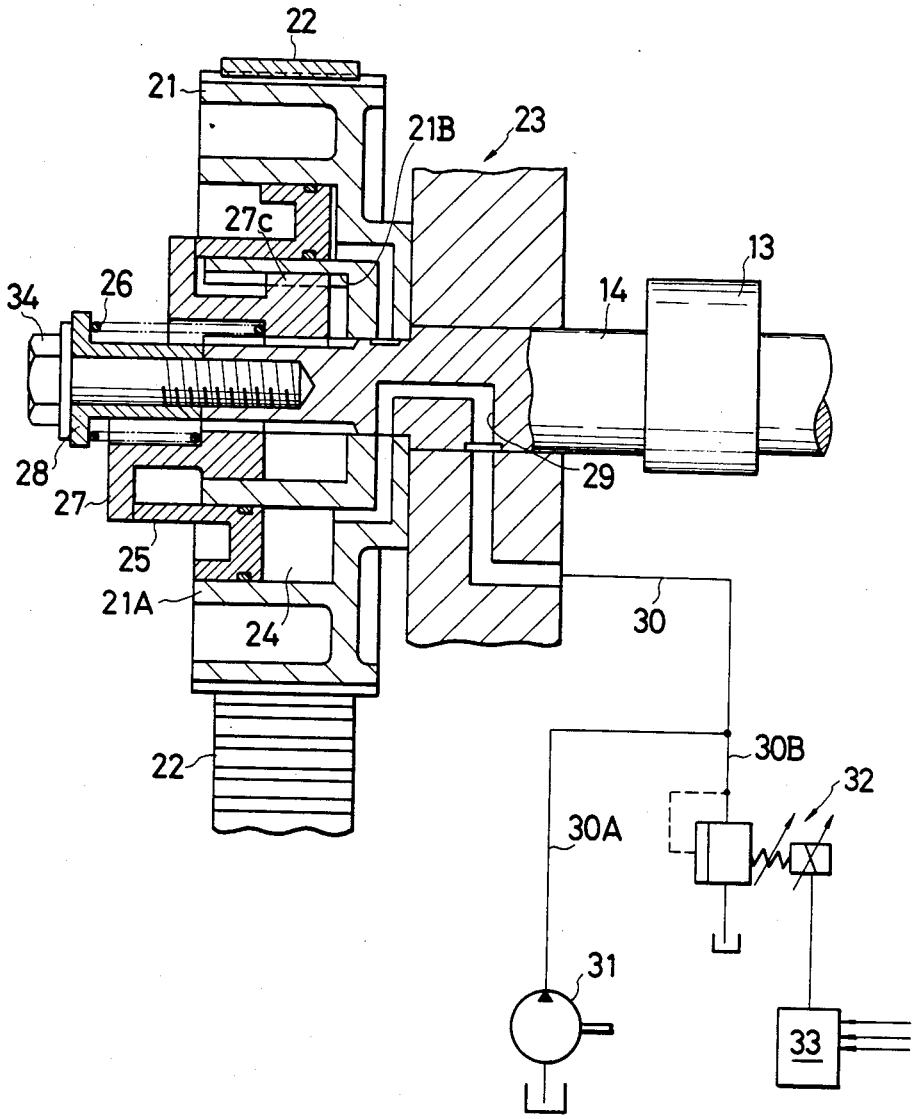
FIG. 9 is a cross sectional view showing the phase controlling unit of the apparatus shown in FIG. 8(A)
Figure 10:
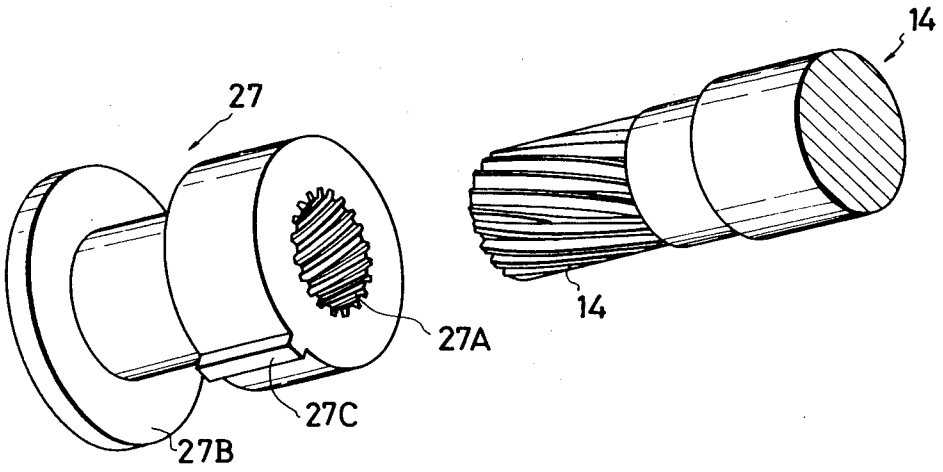
FIG. 10 is a exploded perspective view showing the slider and cam shaft end of the unit shown in FIG. 9.

In FIG. 9, a hydraulic passage 29 is formed in the cam shaft 14 and the timing pulley 21. One end of the hydraulic passage 29 communicates with the hydraulic chamber 24, and the other end thereof with an external hydraulic passage 30. The other end of the passage 30 is divided into two, one 30A of which communicates with an oil pump 31, the other 30B thereof with a hydraulic pressure control valve 32. The hydraulic pressure control valve 32 controls the pressure of hydraulic supplied to the hydraulic chamber 24 from the oil pump 31 by a control circuit 33 according to engine operating conditions such as engine speed, throttle valve opening, intake pressure, intake air quantity, etc. A tap bolt 34 fastens the stopper member 28 to the end surface of the cam shaft 14.

An actuator for controlling the turn of the cam control shaft 18 will be described with reference to FIG. 11. In the figure, the cam shaft 14 is rotatably driven in synchronous with a crank shaft. A cam control shaft 18 is provided above the cam shaft 14 in parallel therewith to control the lift control cam 17. The cam control shaft 18 is connected to the cam shaft 14 through a below mentioned gear mechanism and a pair of stepping clutches 39A and 39B in freely rotatable manner in both directions.

Namely, the rear end of the cam shaft 14 having the timing pulley 21 fixed to front end thereof is provided with a first gear 35. the first gear 35 engages with a pair of second gears 37A and 37B which are supported at the sides of the cam shaft 14. Rotation shaft 36A and 36B of the second geares 37 A and 37B are provided with third gears 38A and 38B fixed thereto respectively. The third gears 38A and 38B engage with fourth gears 40A and 40B which are positioned below the third gears 38A and 38B. The torques of the fourth gears 40A and 40B are transmitted to rotation shafts 41A and 41B through the stepping clutches 39A and 39B respectively. The rotation shaft 41A is provided fixedly with a fifth gear 42 which engages with a sixth gear 44 provided fixedly on an extension shaft 18A. The extension shaft 18A is connected coaxially to the control shaft 18 by a coupling 47 so that the both shafts revolve integrally. The rotation shaft 41B is provided fixedly with a pulley 43. A belt 46 is stretched around the pulley 43 and a pulley 45 which is fixed to the extension shaft 18A.

The revolution of the cam shaft 14 is reduced by the first and second gears 35, 37A, and 37B, and the third and fourth gears 38A, 38B, 40A, and 40B, transmitted intermittently to the rotation shafts 41A and 41B through the stepping clutches 39A and 39B, and then transmitted to the cam control shaft 18 from the extension shaft 18A through the fifth and sixth gears 42 and 44, and pulleys 43 and 45. At this moment, the stepping clutches 39A and 39B are driven separately with control signals $S_1$ and $S_2$ respectively sent from the control circuit 33. Supposing both the rotation shafts 36A and 36B are revolving in an arrow A direction in FIG. 11. If the stepping clutch 39A takes its coupled condition (the stepping clutch 39B being uncoupled in turn), the rotation shaft 41A revolves in an arrow B direction in the figure to turn the cam control shaft 18 in an arrow C direction. If the stepping clutch 39B takes its coupled position (the stepping clutch 39A being uncoupled), the rotation shaft 41B revolves in an arrow B direction to turn the cam control shaft 18 in the reverse (arrow D) direction. Thus, the stepping clutches 39A and 39B perform the connection of clutches respectively by a predetermined turning angle according to supplied input pulses. The control circuit 33 is provided with signals related to engine speed, throttle, opening, clutch, gear, etc., and selects one of pulse like control signals $S_1$ and $S_2$ according to the engine operating conditions to output the selected signal to the stepping clutch 39A and 39B. The operation of the apparatus will be described hereunder.

Supposing the engine is operated with slow speed and low load. If the lift control cam 17 turns to contact the lever 16 with the cam surface 17A which lifting amount is small, the lower surface 16A of the free end portion of the lever 16 is separated from the back surface 15B of the rocker arm 15. Accordingly, the lift of the intake valve 12 becomes the one indicated by a curve X in FIG. 13. The lift control cam 17 is driven and rotated by an actuator mechanism which will be explained later through the cam control shaft 18.

In this case, the phase control unit 23 is actuated simultaneously to the up and down movement of the lever 16, i.e., the turn of the lift control cam 17. Namely, the hydraulic pressure introduced into the hydraulic chamber 24 through the oil pump 31 is controlled by the hydraulic control valve 32 according to the engine operating conditions such as engine load, and said hydraulic pressure moves the slider 27 in a rightward direction or leftward direction in FIG. 9 through the piston 25 against the action of the coil spring 26. As a result, the cam shaft 14 is turned through the male spline 14A engaging with the female spline 27A of the slider 27 so that the rotational phase of the drive cam 13 of the cam shaft 14 is controlled to the advancing side or delaying side.

In slow-speed and low-load conditions, the slider 27 is moved rightward in FIG. 9 (it is shown in the upper half of FIG. 9) so that the cam shaft 14 is rotated in one direction through the female and male splines 14A and 27A to control the phase of drive cam 13 toward the advancing side. Therefore, the valve open and close timing of the intake valve 12 is displaced toward the advacing side in comparison with a prior art example which is indicated by a curve Y in FIG. 12. In an ordinary SOHC engine in which the drive cam 13 is provided on the same cam shaft 14, the valve open and close timing of the exhaust valve 12 is displaced toward the advancing side so that the overlapping amount of the intake and exhaust valves becomes small and the closure timing of the intake valve 12 becomes small and the closure timing of the intake valve 12 becomes before the bottom dead center of an intake stroke. As a result, the amount of residual gas in the combustion chamber is reduced to improve the combustion condition. Further, the valve closure timing of the intake valve 12 is advanced to shorten the effective intake stroke so that the pumping loss is reduced, and the thermal efficiency of the engine is improved. Here, the effective intake stroke of the engine means the intake stroke during which the intake valve 12 is opened. If the intake stroke is shortened, the quantity of air-fuel mixture filling the engine cylinder is limited such that the throttle valve keeps an open state by the period. As a result, intake negative pressure is reduced to reduce the pumping loss generated in the cylinder.

In a middle load operating region which is most frequently used in an actual operation, a problem is the exhaust of hazardous nitrogen oxides ($NO_x$). In the operating region, the exhaust gas reflux (EGR) into intake air is performed. Therefore, a reflux means such as an EGR control valve is needed to control the EGR quantity.

Figure 13:
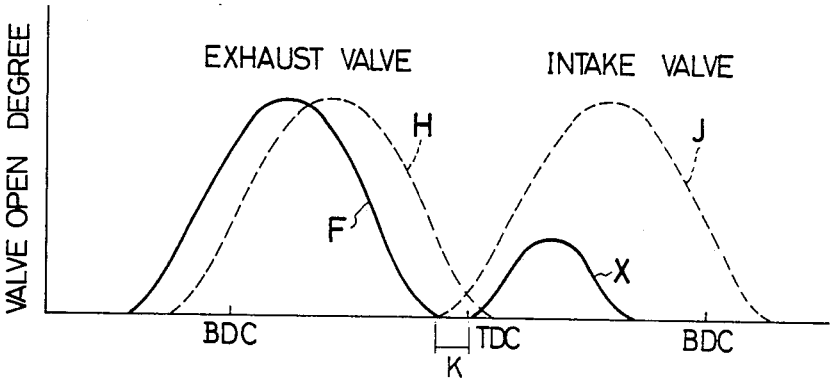

However, the present invention controls to advance the phase of the drive cam 13 in the middle load operating state of the engine further to the advancing side to bring the valve close timing of the exhaust valve before the top dead center as indicated by a curve F in FIG. 13 so that the part of exhaust gas may be trapped in the combustion chamber at the end of exhausting stroke (Ref. an arrow K). Since the temperature of trapped exhaust gas is high (EGR gas introduced into an external passage is cooled by the passage itself), the present invention provides effects that the combustion of the next cycle is expedited and that the generation of nitrogen oxides ($NO_x$) is suppressed. Accordingly, the present invention has an advantage that an ordinary EGR unit will not be needed.

Figure 12:
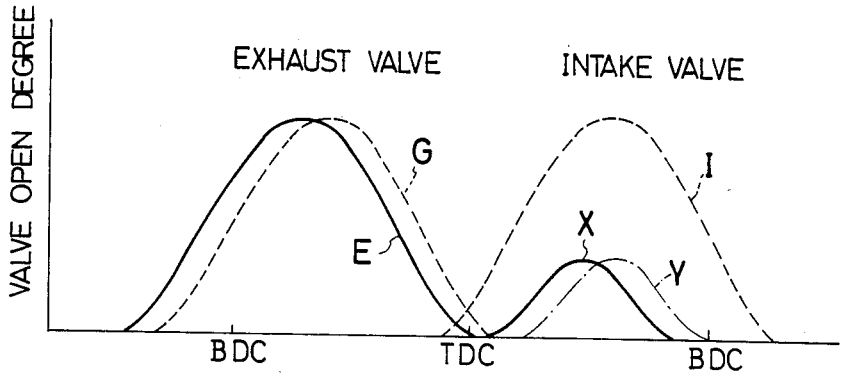
FIGS. 12 and 13 are diagrams showing the valve lifting characteristics.

In the large-load operating state of engine, the lift characteristic of the exhaust valve becomes large as indicated by dotted lines G and H in FIGS. 12 and 13. The lift of the intake valve 12 becomes also large as indicated by dotted lines I and J. Therefore, high charging efficiency is obtained in the large-load operating condition to increase the engine output.

The lift control cam 17 is turned by the operation of the actuator through the cam control shaft 18. The operation of the actuator shown in FIG. 11 will be explained.

Figure 11:
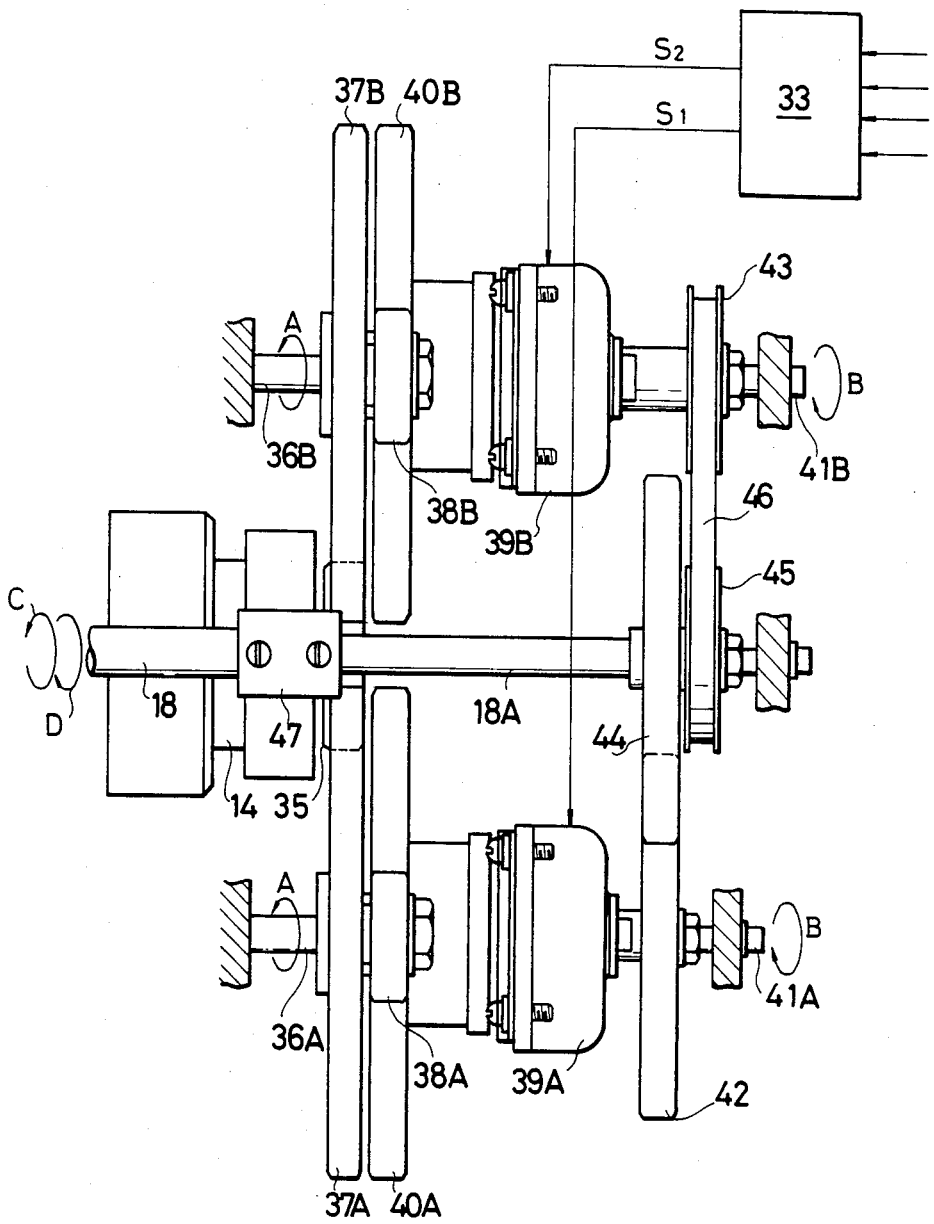
FIG. 11 is a plan view showing the overall constitution of an actuator mechanism for driving a lift controlling cam.

The cam shaft 14 is turned in synchronous with the crank shaft of engine in a clockwise direction viewing from the left side of FIG. 11. At this moment, the rotation shafts 36A and 36B are rotated in an anticlockwise direction (an arrow A) through the first gear 35 and the second gears 37A and 37B. The fourth gears 40A and 40B are reduced their speeds by said gear train and rotated in a clockwise direction through the third gears 38A and 38B fixed to the rotation shafts 36A and 36B respectively.

If a pulse signal is inputted into the stepping clutch 39A from the control circuit 33, the stepping clutch 39A is excited for a predetermined excitation period according to the pulse signal to connect the fourth gear 40A with the shaft 41A and turn them in an arrow B direction by a predetermined angle. Therefore, the cam control shaft 18 rotates in an arrow c direction by the predetermined angle through the fifth gear 42, sixth gear 44, and extension shaft 18A. As a result, the lift control cam 17 is turned through the cam control shaft 18 and contacts the lever 16 with the cam surface 17A having, for instance, small lifting amount.

If the stepping clutch 45B is excited, the rotation in a clockwise direction (arrow B) of the rotation shaft 41B is transmitted to the control shaft 18 from the extension shaft 18A through the timing pulleys 43 and 45 so that the cam control shaft 18 may be rotated in a clockwise direction (arrow D) by a predetermined amount. The lift control cam 17 is turned in the same direction and contacts the lever 16 with the cam surface 17A having, for instance, a large lifting amount. If both the stepping clutches 39A and 39B are not excited, the rotation shafts 36A and 36B are idled in synchronous with the cam shaft 14, and the lift control shaft 18 is not turned.

In order to select the cam surface 17A of the lift control cam 17 according to the engine operating conditions, the number of steps and the angle of steps of the stepping clutches 39A and 39B will be properly set. If the rotating speed of cam shaft 14 is high, the excitation time of stepping clutches 39A and 39B may be shortened to operate the stepping clutches 39A and 39B by a predetermined stepping angle. The speed reducing ratio by the gear train may be increased to reduce the rotational error of the lift control cam 17. Although spur gears have been used in the embodiment, worm gears or flywheel gears may naturally be used.

The effectiveness of the stepping clutches will be improved if a multisurface cam which will be described with reference to FIGS. 22(A) to 24 is used as the lift control cam.

FIGS. 14 to 21 show another embodiment of a phase control unit according to the present invention. In this embodiment a centrifugal speed governing mechanism is used as the phase control unit.

Figure 14:
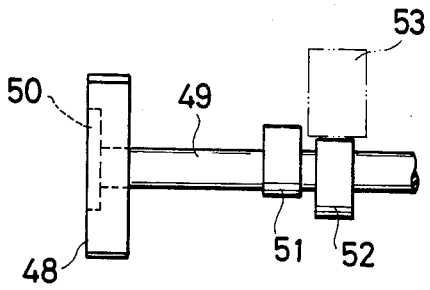
FIG. 14 is an overall view showing an valve driving apparatus according to the present invention.
Figure 15:
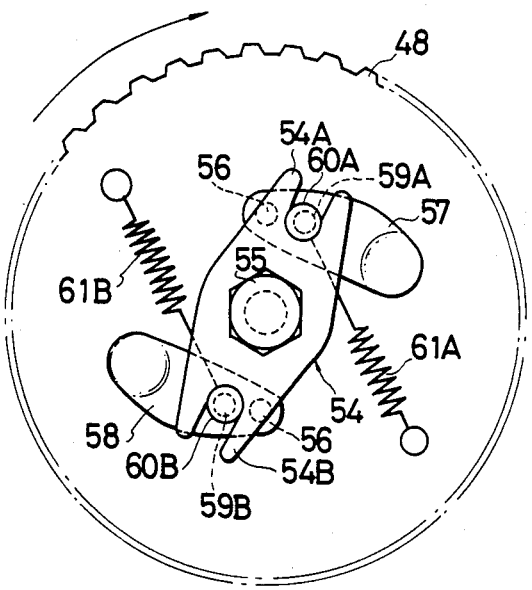
FIG. 15 is a front view showing the centrifugal speed governing mechanism of the apparatus shown in FIG. 14.
Figure 16:
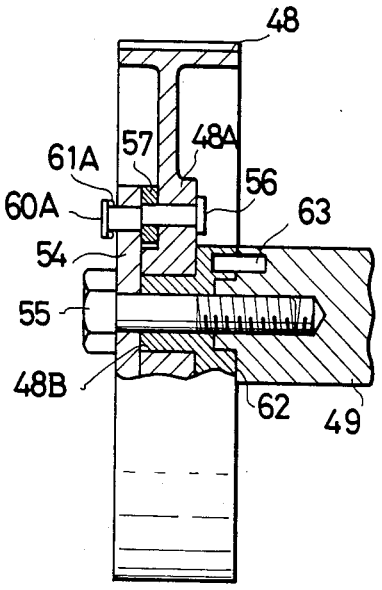
FIG. 16 is a vertical cross sectional view showing the mechanism shown in FIG. 15.

Firstly, the constitution of the embodiment will be described. In FIG. 14, a centrifugal speed governing mechanism 50 is arranged between a cam gear 48 and a cam shaft 49. The cam shaft 49 is fixedly provided with an exhaust cam 51 and an intake cam 52. Above the intake cam 52 in FIG. 14, there is provided a valve timing and lift control mechanism 53 which will be described later.

Figure 17:
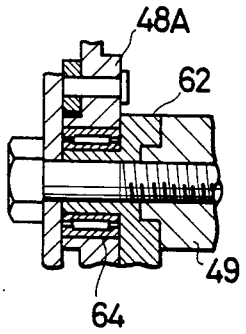
FIG. 17 is a cross sectional view showing the main part of mechanism to which a roller bearing is provided.
Figure 18:
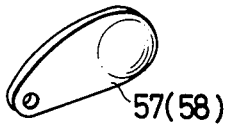
FIG. 18 is a perspective view showing the weight of the mechanism shown in FIG. 15.

The centrifugal speed governing mechanism 50 will be described with reference to FIGS. 15 to 18. A bearing hole 48B is formed at a boss portion 48A of the cam gear 48. In the bearing hole 48B, there is inserted a collar 62 in a freely slidable manner. The collar 62 is fixed to the cam shaft 49 with a pin 63 and with a bolt 55 via a supporting member (flange) 54 having fork portions 54A and 54B at both ends thereof. As shown in FIG. 17, a roller bearing 64 may be arranged between the boss portion 48A and the collar 62. Supporting shafts 56 are inserted by pressure and fixed in the boss portion 48A of the cam gear 48. At the ends of the supporting shafts 56, there are provided a pair of weights 57 and 58 as shown in FIG. 18 respectively, said weights being rotatable around one ends thereof. Pins 59A and 59B are inserted and fixed into substantially the centers of the weights 57 and 58 respectively. The pins 59*a* and 59B engage with collars 60A and 60B respectively in a freely slidable manner. The collars 60A and 60B are held between the branches of the fork portions 54A and 54B respectively of the supporting member 54 and supported by the supporting member 54. The torque of the cam gear 48 is transmitted to the cam shaft 49 from the supporting shaft 56 through the weights 57 and 58, pins 59A and 59B, collars 60A and 60B, and supporting member 54. One ends of springs 61A and 61B are hooked on the ends of pins 59A and 59B respectively, while the other ends of the pins are fixed to the side wall of the cam gear 48. The springs 61A and 61B pull the weights 57 and 58 so that the other ends of the weights 57 and 58 tend toward the center (inner side) of cam gear 48.

Figure 19:
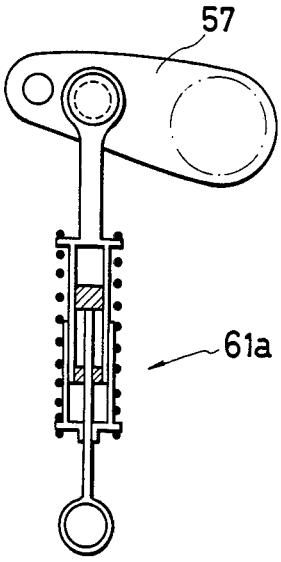
FIG. 19 is a view showing the modification of a spring included in the mechanism shown in FIG. 15.

FIG. 19 shows a modification of the spring 61A (61B), in which the spring 61A (61B) is provided with an oil damper 6/a which attenuates the resonance of the spring 61A (61B) caused by the torque variation of the cam shaft 49 and prevents the weight 57 (58) from hitting on the cam gear 48.

Figure 20:
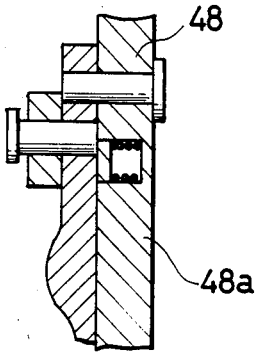
FIGS. 20, 21(A) and 21(B) are view showing modifications in which friction members are added to the mechanism shown in FIG. 15.

FIG. 20 shows a modification of the centrifugal speed governing mechanism 50, in which a friction member 48*a* is provided in a recess formed on the side face of the cam gear 48, said friction member 48*a* is arranged to be pressed against the lower surface of the weight 57 (58) by means of a spring to attenuate the resonance of the spring 61A (61B) caused by the torque variation of the cam shaft 49 and prevent the weight 57 (58) from hitting on the cam gear 48.

Figure 21A:
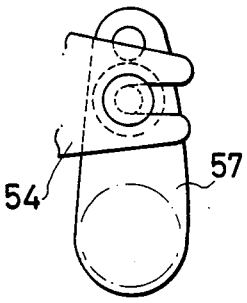
Figure 21B:
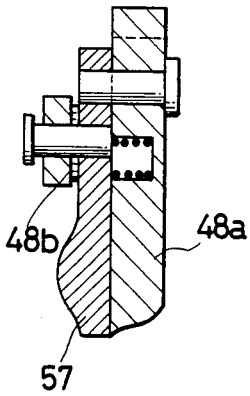

FIGS. 21(A) and 21(B) shows another modification of the centrigugal speed governing mechanism 50, in which a friction member 48*b* is provided between the fork portion 54A (54B) and the weight 57 (58) with a spring being provided in the recess of the cam gear 48. The effect of the friction member 48*b* is the same as that of the friction member 48*a*.

FIGS. 22(A) to 24 show another embodiment of a valve lift control unit according to the present invention.

Figure 22A:
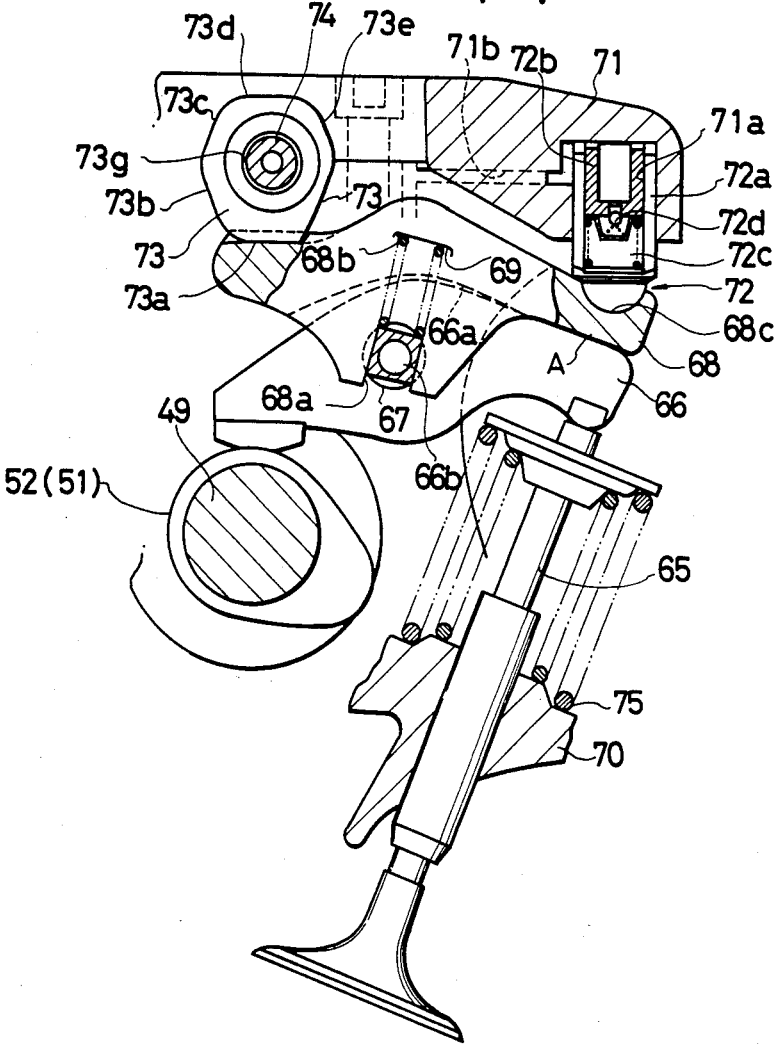
FIGS. 22(A) and 22(B) are a vertical cross sectional view showing a valve timing and lift controlling unit according to the present invention.
Figure 22B:
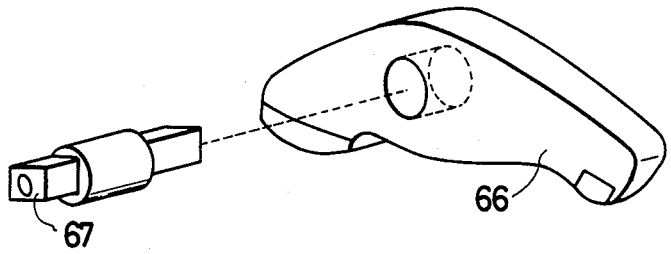

In FIGS. 22(A) and 22(B), a drive cam (for intake valve or for exhaust valve) 52 (51) is fixed to the cam shaft 49 and rotates in synchronous with the engine. One end of a rocker arm 66 contacts the drive cam 52, and another end thereof contacting the stem end of an intake valve (or exhaust valve) 65. A back surface 66*a* which has a curved contour of the rocker arm 66 contacts through a fulcrum a lever 68 which supports in its groove 68*a* through a supporting member 67 a shaft 66*b* projecting from both side walls of the rocker arm 66. Between a spring seat 68*b* formed on the lever 68 and the supporting member 67, there is arranged a spring 69 having a small spring constant to press downwardly the rocker arm 66.

A bracket 71 is arranged above a cylinder head 70. A hydraulic pivot 72 is engaged with an supported by the bracket 71. The spherical lower end surface of the hydraulic pivot 72 engages with a recessed portion 68*c* formed on the top of the other bracket of the lever 68 on the stem end side of the intake valve 65. The lever 68 is pivotally supported by the engaging portion. A lift control cam 73 is fitted to the bracket 71 in a freely rotatable manner. The lift control cam 73 contacts the top wall of the lever 68 on the drive cam 52 side to regulate the pivotal position of the lever 68.

The hydraulic pivot 72 includes the lower end surface engaging with the recessed portion 68*c* of the lever 68, an outer cylinder 72*a*, periphery of which is slidably inserted into a fitting hole 71*a* formed on the bracket 71, an inner cylinder 72*b* inserted into the outer cylinder 72*a*, a hydraulic chamber 72*c* formed between the outer and inner cylinders, and a check valve 72*d* provided for the hydraulic chamber 72*c*. Hydraulic pressure is supplied from a hydraulic passage 71*c* formed inside the bracket 71 to the hydraulic chamber 72 through the inside of the inner cylinder 72*b* and the check valve 72*d* to keep the valve clearance constant.

Figure 23:
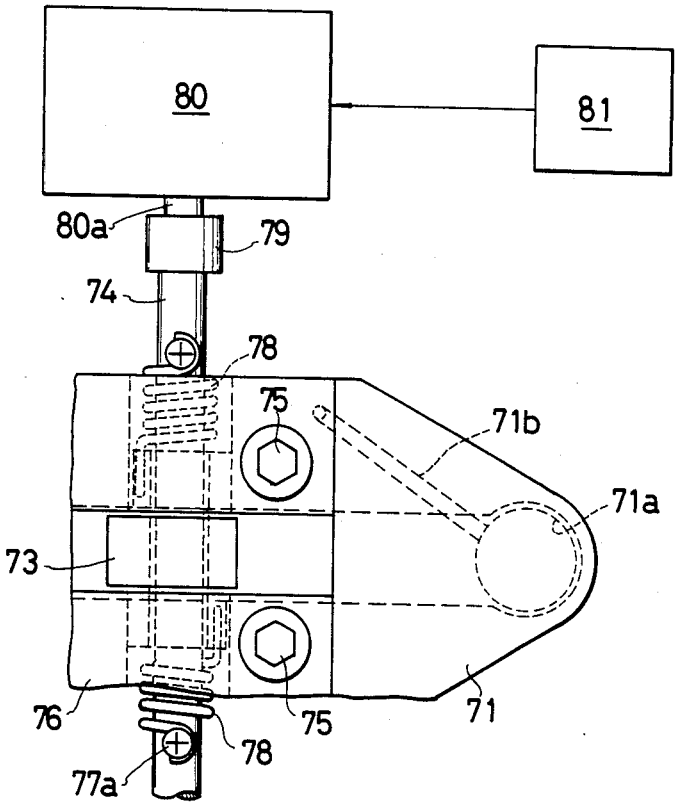
FIG. 23 is a plan view showing a part of the unit shown in FIGS. 22(A) and 22(B)
Figure 24:
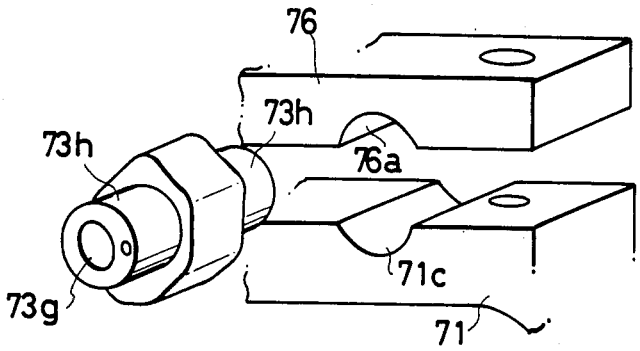
FIG. 24 is an exploded perspective view showing the fitting portion of a lift controlling cam.

The lift control cam 73 has on its periophery substantially flat six cam surfaces 73*a* to 73*f* to change in phases the lift of the intake valve 65. The lift control cam 73 further has at its center a hole 73 for passing a cam control shaft 74 which will be explained later. As shown in FIGS. 23 and 24, the peripheries of the cylindrical portions 73*h* formed to project from both sides of the lift control cam 73 are supported in a freely rotatable manner between lower arcuate grooves 71*c* formed on the bracket 71 and upper arcuate grooves 76*a* formed on a pair of caps 76.

The number of lift control cams 73 is equal to the number of cylinders. Each lift control cam 73 has the hole 73*g* which is formed through the center of the lift control cam 73. The cam control shaft 74 is inserted into the hole 73. Coil springs 78 are placed on the cam control shaft 74 at both sides of the lift control cam 73. One ends of the coil springs 78 are hooked on fastening screws 74*a* which are screwed into the outer wall of the cam control shaft 74. The other ends of the coil springs 78 are inserted to be fixed into holes formed on the side wall of the cylindrical portion 73*h* of the lift control cam 73.

One end of the cam control shaft 74 is connected to a drive shaft 80*a* of a stepping motor 80 through a joint 79. The stepping motor 80 is driven by a control circuit 81 according to the engine operating conditions such as engine speed, throttle valve opening, cooling water temperature, intake air flow, intake negative pressure, etc., to rotate the cam control shaft 74. The numeral 75 represents a valve spring.

The operation of the unit shown in FIGS. 14 to 21 and the lift control cam shown in FIGS. 22(A) to 24 will be described.

Supposing the engine is operated at high speed. If the cam gear 48 is rotated in an arrow direction shown in FIG. 15, the centrifugal force acting on weights 57 and 58 exceeds the tension of springs 61A and 61B so that the free ends of the weights 57 and 58 move toward peripheral direction of the cam gear 48. Accordingly, the supporting member 54 is turned in an anticlockwise direction in FIG. 15 through collars 60A and 60B coupled in the fork portions 54A and 54B. As a result, the rotational phase of cam shaft 49 which rotates together with the supporting member 54 may be controlled toward the delaying side. At the same time, the lift control cam 73 contacts the lever 68 with a cam surface 73*a* which has a maximum value of lift so that the lever 68 will be pushed down up to its reaching end on the drive cam 52 side. Therefore, the lower surface of the lever 68 which contacts through a fulcrum the back surface 66*a* of the rocker arm 66 is lowered so that the contacing point A may be moved toward the drive cam 52 side to transmit the lift of valve to the intake valve 65. As indicated by a curve M in FIG. 25, the amount of lift is increased, and the valve timing is displaced toward the delaying side. As a result, high charging efficiency can be obtained by utilizing the inertial action of intake air, and high output is maintained. A curve M' indicates the lifting characteristic of an exhaust valve.

If the engine is operated with slow speed, the rotational speed of the cam gear 48 is slow, and the cenetrifugal force acting on the weights 57 and 58 is small. Accordingly, the free ends of the weights 57 and 58 are pulled toward the center of the cam gear 48. As a result, the supporting memeber 54 is turned in a clockwise direction in FIG. 15 to control the rotational phase of the cam shaft 49 toward the advancing side. In this case, the cam surfce 40*e* having a small lifting amount contacts the lever 68 so that the end of the lever 68 on the drive cam 52 side is raised due to the pivotal movement with the recessed portion 68c as a fulcrum, and the lower surface of the lever 68 is also moved upwardly.

The lower surface of the lever 68 becomes a fulcrum to transmit the lift of the drive cam 52 from the rocker arm 66 to the intake valve 65. The initial position of the fulcrum when the drive cam 52 contacts the rocker arm 66 in a base circle moves rightward in FIGS. 22(A) and 22(B), namely in an opposite direction of the fulcrum movement after the lifting of the case in which the lever 68 contacts the cam surface 73 having the maximum lifting amount.

Figure 25:
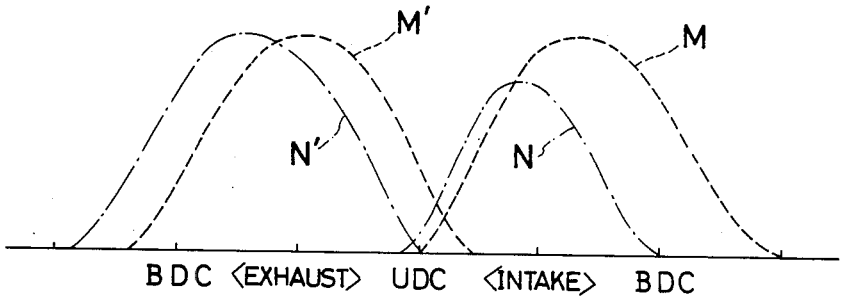
FIG. 25 is a diagram showing valve lifting characteristics.

As indicated by a curve N shown in FIG. 25, the valve lifting amount of the intake valve 65 becomes small so that the valve open timing may be displaced toward the delaying side. A curve N' indicates the case of exhaust valve. As a result, the overlap of the intake and exhaust valves is made small to prevent the counter flow of exhaust gas and reduce the residual gas ratio in the cylinder, thereby realizing the high charging efficiency. Further, the valve close timing is advanced toward the bottom dead center so that the stable combustion state of engine is realized in the low-speed and no-load operating condition to secure the stable low-speed operability.

Figure 26A:
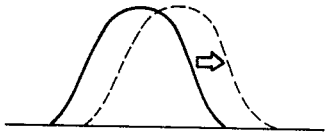
FIGS. 26(A), 26(B) and 26(C) are diagrams showing the valve lifting characteristics in which the present invention is applied for a DOHC type valve mechanism.
Figure 26B:
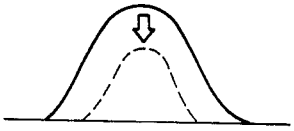
Figure 26:
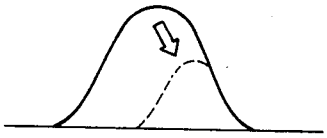

FIGS. 26(A), 26(B), and 26(C) show valve lifting characteristics of the case in which the present invention is applied for a DOHC mechanism having intake and exhaust valves with separate cam shafts.

By virture of the cam phase control mechanism, it is obtained the lifting characteristic (an arrow mark) in which the lifting amount is constant, and the valve timing is variable, as shown in FIG. 26(A). By virtue of the valve lift control mechanism, it is obtained, as shown in FIG. 26(B), the lifting characteristic in which the lifting amount is variable, and the valve timing is changed. By virtue of both the mechanisms, as shown in FIG. 26(C), the valve (for instance an exhaust valve) open and close timing and valve lifting amount are variably controlled and optimized according to the engine operating conditions.

As described in the above, the present invention realizes to control the phase of intake and exhaust drive cams to optimize the open and close timing of the intake and exhaust valves so that the charging efficiency may be improved for slow-speed to high-speed engine operating conditions. In the slow-speed and no-load engine operating conditions, the present invention realizes to stabilize a combustion state to secure the stable slow-speed operability. Further, the present invention reduces the pumping loss and improve the thermal efficiency in the low-load engine operating conditions. In the middle-load engine operating conditions, the generation of hazardous nitride oxides will be suppressed to eliminate the necessity of a conventional exhaust gas reflux (EGR) unit.

Since the lift control cam is precisely rotated in one embodiment by the stepping clutch mechanism with a rotating portion of the engine as a power source, the responsibility of the apparatus is greatly improved, and electric load and engine load are extremely decreased. Further, production cost is greatly reduced because a phase detector, etc., of the lift control cam is not required. Since the phase of cam is continuously changed according to the engine speed, in another embodiment, only by utilizing centrifugal force, the constitution of apparatus becomes simple to reduce the production cost.

Various modifications will become possible for those skilled in the art after receiving the teachings of the present disclosure without departing from the scope thereof.

What is claimed is:

1. An apparatus for driving a valve (12) of an internal combustion engine, comprising;

a valve lift controlling means connected to said valve (12) to control the lift of said valve (12) in response to the engine operating conditons;

a valve driving cam (13) fixed on a first cam shaft (14) and being in contact with said valve lift controlling means (15); and a phase controlling means (23) arranged on said first cam shaft (14) to control the rotational phase of said valve driving cam relative to the phase of the piston position in the engine.

2. An apparatus as claimed in claim 1, in which said valve lift controlling means comprises;

a rocker arm (15), one end of which being engaged with the stem end of said valve (12), the other end contacting said valve driving cam (13);

a lever (16), one end of which being pivotally fixed to the body of engine, the lower surface (16A) of said lever contacting the upper surface (15B) of said rocker arm (15) through a fulcrum which position is changeable therebetween, said valve driving cam (13) through the rocking motion of said rocker arm (15) with said fulcrum as the center of said rocking motion;

a valve lift controlling cam (17) fixed on a second cam shaft (18), said valve lift controlling cam (17) contacting the upper surface (16B) of said lever (16); and an actuator means for causing the turn of said second cam shaft (18), said actuator means being operated according to the engine operating conditions to turn said second cam shaft (18) to control the lift of said valve via said valve lift controlling cam (17) and said lever (16).

3. An apparaus as claimed in claim 2, in which said actuatcr means comprising;

a first clutch means (39A) arranged to connnect said first cam shaft (14) with said second cam shaft (18) through connecting means;

a second clutch means (39B) arranged to connect said first cam shaft (14) with said second cam shaft (18) through connecting means; and a control circuit (33) sending control signals ($S_1$, $S_2$) to said first and second clutch means (39A, 39B) according to the engine operating conditions, wherein said first and second clutch means (39A, 39B) are controlled to take selectively and exclusively a coupled conditions according to the signals sent from said control circuit (33), the rotation of said first cam shaft (14) causing said second cam shaft (18) to turn in one direction if said first clutch means (39A) takes a coupled position and said second clutch means (39B) takes an uncouples position, the rotation of said first cam shaft causing said second cam shaft (18) to turn in the other direction if said first clutch means takes uncoupled and said second clutch means takes coupled.

4. An apparatus as claimed in claim 3, in which said first and second clutch means (39A, 39B) comprise stepping clutches respectively.

5. An apparatus as claimed in claim 2, in which said valve lift controlling cam (73) comprises a multisurface cam.

6. An apparatus as claimed in claim 1, in which said phase controlling means comprises;

a slider (27) having a female spline (27A) formed inside thereof, said female spiral spline (27A) being engaged with a male spiral spline (14A) formed at the end of said first cam shaft (14);

a pulley (21) having a central cylindrical portion (24) into which said slider (21) is inserted in a freely slidable manner;

a hydraulic means (30, 31, 32) for causing said slider (21) to slide in said cylindrical portion (24); and a control circuit for (33) operating said hydraulic means according to the engine operating conditions to cause said slider to slide in said cylindrical portion (24) of said pulley, said sliding motion turning said first cam shaft with respect to said pulley due to said spiral spline engagement, thereby advancing or delaying the open and close timing of said valve.

7. An apparatus as claimed in claim 1, in which said phase controlling means comprises;

a gear (48) fitted to one end of said first cam shaft (49) to transmit torque to said first shaft;

a plurality of weights (57, 58) fixed pivotally at one ends thereof on the side face of said gear (48);

a plurality of spring means (61A, 61B), one ends thereof being fixed on said side face of said gear (48), the other ends thereof being fixed to said weights (57, 58) to pull the free ends of said weights (57, 58) toward the inner side of said gear (48);

a supporting member (54) arranged on said side face of said gear (48), ends of said supporting member being forked, said supporting member being fixed to the end of said first cam shaft (49) by a fixing means (55); and pins (60A, 60B) fixed on said weights (57, 58) respectively about the middle portions thereof, each of said forked ends of said supporting member (54) being arranged such that each of said pins (60A, 60B) are located between the branches of each forked end, wherein said first cam shaft (49) is turned with respect to said gear according to the pivotal movement of said weights (57, 58) through said pins (60A, 60B) and said supporting member (54) due to centrifugal force acting on said weights while said gear being rotated, thereby advancing or delaying the open and close timing of said valve.

8. An apparatus as claimed in claim 6, in which said gear is fitted to the end of said first cam shaft (49) through a collar (62) fitted to said end of said first cam shaft (49) by a fixing means.

9. An apparatus as claimed in claim 7, in which a bearing means (64) is placed between said gear and said end of said first cam shaft (49).

10. An apparatus as claimed in claim 6, in which said spring means are provided with damper means (61*a*) respectively.

11. An apparatus as claimed in claim 6, in which friction members (48*a*) together with resilient members are provided between said weights and said gear.

12. An apparatus as claimed in claim 11, in which said friction members (48*a*) together with resilient members are arranged in recesses formed on said side face of said gear (48).

13. An apparatus as claimed in claim 6, in which friction members (48*b*) are arranged between said weights (57, 58) and said forked ends of said supporting member (54) while resilient members are placed in recesses formed under said weights (57, 58) and on said side face of said gear (48).

14. An apparatus as claimed in claim 1, in which said valve lift controlling means comprises;

a rocker arm (66), one end of which being engaged with the stem end of said valve (65), the other end contacting said valve driving cam (52);

a lever (68), lower surface thereof contacting the upper surface of said rocker arm (66) through a fulcrum which position is changeable therebetween, said valve being driven according to the rotation of said valve driving cam (52) through the rocking motion of said rocker arm (66) with said fulcrum as the center of said rocking motion;

a bracket (71) arranged above said lever (68), one lower end thereof being provided with a contacting means (72) which contacts one upper end of said lever (68), the other end of said bracket (71) being provided with a valve lift controlling cam (73) which is fixed to a cam shaft (74) and has a plurality of cam surfaces, one of said cam surfaces (73*a*) of said valve lift controlling cam (73) contacting the other upper end of said lever (68);

an actuating means (80) for causing said cam shaft (74) to rotate to change the cam surface, which will contact said other upper end of said lever (68), of said valve lift controlling cam (73), thereby changing the lift of said valve; and a control circuit (81) for controlling the operation of said actuating means (80) according to the engine operating conditions.

15. An apparatus as claimed in claim 14, in which said contacting means (72) is a hydraulic zero lush adjuster for keeping the valve clearance constant.

16. An apparatus as claimed in claim 14, in which said actuating means (80) is a stepping motor.

17. An apparatus as claimed in claim 14, in which said rocker arm (66) has projections extending outwardly from both sides thereof, said projections being received in grooves formed on the lower surface of said lever (68) through spring members (69) which push said rocker arm (66) downwardly.

* * * * *